US005524764A

United States Patent [19]

Kaufman et al.

[11] Patent Number: 5,524,764

[45] Date of Patent: Jun. 11, 1996

[54] COMBINATION ABSORBENT APPLICATOR, WIPE FOR TEETH AND ORAL APPLICATOR

[76] Inventors: Richard Kaufman, 50 Vista Dr., Syosset, N.Y. 11791; Salvatore Buda, 28 Westwood Cir., Roslyn, N.Y. 11577

[21] Appl. No.: 346,880

[22] Filed: Nov. 30, 1994

[51] Int. Cl.[6] ..... B65D 81/00

[52] U.S. Cl. ..... 206/581; 206/362.2; 132/309; 132/312; 132/314

[58] Field of Search ..... 15/167.1, 227; 132/308, 309, 310, 312, 314; 206/362.1, 362.2, 581, 277, 443, 388, 63.5

[56] References Cited

U.S. PATENT DOCUMENTS

| | | | |
|---|---|---|---|
| 2,223,952 | 12/1940 | Darmody | 132/308 |
| 4,105,120 | 8/1978 | Bradberry | 206/581 |
| 4,880,111 | 11/1989 | Bagwell et al. | 206/362.2 X |
| 5,068,941 | 12/1991 | Dunn . | |
| 5,107,562 | 4/1992 | Dunn . | |
| 5,181,531 | 1/1993 | Escoto et al. | 132/308 |
| 5,213,428 | 5/1993 | Salman . | |
| 5,287,584 | 2/1994 | Skinner . | |
| 5,348,153 | 9/1994 | Cole | 206/581 X |

*Primary Examiner*—Jacob K. Ackun
*Attorney, Agent, or Firm*—Michael I. Kroll

[57] ABSTRACT

A combination absorbent applicator, wipe for teeth and oral applicator comprising a sheath having a closed distal end and an open proximal end for receipt of a fingertip or finger. An abrasive absorbent material pad is on an exterior surface of the sheath adjacent the closed distal end. The abrasive absorbent material pad can be applied to teeth, gums, tongue and lips for cleaning and treatment thereof.

1 Claim, 2 Drawing Sheets

COMBINATION ABSORBENT APPLICATOR, WIPE FOR TEETH AND ORAL APPLICATOR

BACKGROUND OF THE INVENTION

1. Field of the Invention

The instant invention relates generally to dental hygiene devices and more specifically it relates to a combination absorbent applicator, wipe for teeth and oral applicator.

2. Description of the Prior Art

Numerous dental hygiene devices have been provided in prior art. For example, U.S. Pat. No. 5,068,941 to Dunn; 5,107,562 to Dunn; 5,213,428 to Salman and 5,287,584 to Skinner all are illustrative of such prior art. While these units may be suitable for the particular purpose to which they address, they would not be as suitable for the purposes of the present invention as heretofore described.

DUNN, GARY D.

FINGER-MOUNTED TOOTHBRUSH

U.S. Pat. No. 5,068,941

A handless toothbrush formed of an elastomeric material. The toothbrush, in a first embodiment, axially receives the distal end of a finger and has an opening that registers with a fingernail when the brush is worn properly. In a second embodiment, the brush axially receives the entire extent of a finger when fully deployed. Prior to deployment, the toothbrush is in the form of a bag member that has been turned partially inside out, so that the bottom part of the bag member is encased within its folded back upper part, so that the outside surfaces of both the bottom and the top parts are maintained in a substantially sterile condition. A third embodiment adds additional reverse folds and an adhesive strip covered by said folds that maintains the brush against slippage.

DUNN, GARY D.

DISPOSABLE FINGER-MOUNTED TOOTHBRUSH WITH HOLDING MEANS

U.S. Pat. No. 5,107,562

A toothbrush of the type worn on a human finger. The toothbrush includes an inner part that is wholly received within another part when the toothbrush is in a stored condition prior to use. The outer part includes an upper flap and a lower flap that are releasably secured to one another about their respective peripheral borders. When the top flap is peeled back, the bottom flap separates from the top flap and the inner part of the toothbrush, upon which are mounted the bristles of the brush, is exposed. The user of the device grasps the lower flap after it has separated from the upper flap, and this grasping maintains the toothbrush on the user's finger throughout the time the toothbrush is in use.

SALMAN, NASSER

BIODEGRADABLE TOOTHBRUSH

U.S. Pat. No. 5,213,428

A disposable toothbrush formed of a biodegradable material, such as biodegradable plastic. The toothbrush would fit, preferably, over the index finger of a user. By using the index finger, it is easy to reach any part of the teeth by locating the toothbrush, so as to apply a brushing action to the upper and lower teeth, with the toothbrush located on the outside or inside of the index finger. A toothbrush cap provides an opening for receipt of an index finger of a user. On a flattened portion of the toothbrush cap, are defined two to four rows of short bristles, preferably three sixteenths inches in height. These bristles may be formed integrally with the toothbrush cap or include bristles imbedded in the cap. These bristles are impregnated with dehydrated toothpaste, which bonds with the bristles to form a defined layer on top of the bristles. Upon contact with water, the impregnated toothpaste would hydrolyze to aid in brushing of the teeth for a single use. Upon completion of brushing, the toothbrush would be disposed of in its entirety.

SKINNER, JOHN R.

TOOTHBRUSH

U.S. Pat. No. 5,287,584

This invention relates to a novel finger toothbrush. More particularly, this invention pertains to a unique toothbrush, which can fit on a finger of a user for brushing the teeth of the user or the teeth of another human being or animal. The invention comprises a base portion with a plurality of bristles secured in and protruding from the base. A first curved finger gripping device extends from a first side of the base away from the bristles with a second curved finger gripping device extending from a second side of the base away from the bristles. Friction enhancing devices are formed in the interior facing surfaces of the first and second finger gripping device.

SUMMARY OF THE INVENTION

A primary object of the present invention is to provide a combination absorbent applicator, wipe for teeth and oral applicator that will overcome the shortcomings of the prior art devices.

Another object is to provide a combination absorbent applicator, wipe for teeth and oral applicator, comprised of a soft latex sheath with an abrasive absorbent material pad thereon, worn on a finger of a person, so that the abrasive absorbent material pad can be applied to the teeth, gums, tongue and lips for cleaning and treatment.

An additional object is to provide a combination absorbent applicator, wipe for teeth and oral applicator, that is enclosed in a compact portable package, which contains a single supply of toothpaste or medicated gel, dental floss and a toothpick, to be conveniently placed into a wallet, pocket or purse.

A further object is to provide a combination absorbent applicator, wipe for teeth and oral applicator that is simple and easy to use.

A still further object is to provide a combination absorbent applicator, wipe for teeth and oral applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
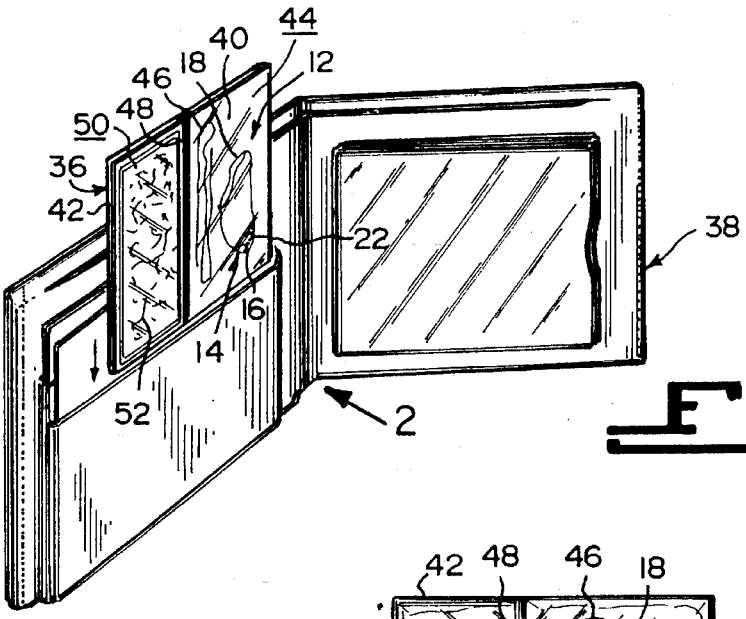
FIG. 1 is a perspective view of a wallet, showing the wipe-applicator enclosed in a compact portable package being inserted into the wallet.
Figure 2:
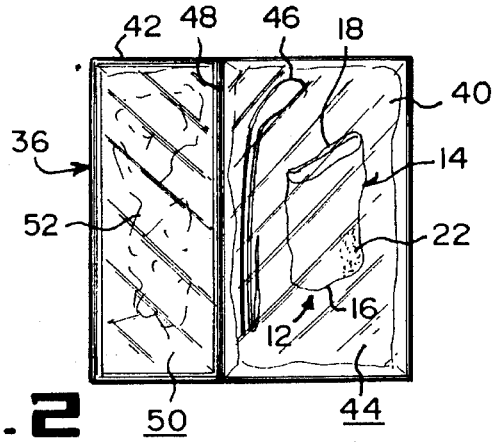
FIG. 2 is a front view of the compact portable package with the wipe-applicator therein, taken in the direction of arrow 2 in FIG. 1.
Figure 3:
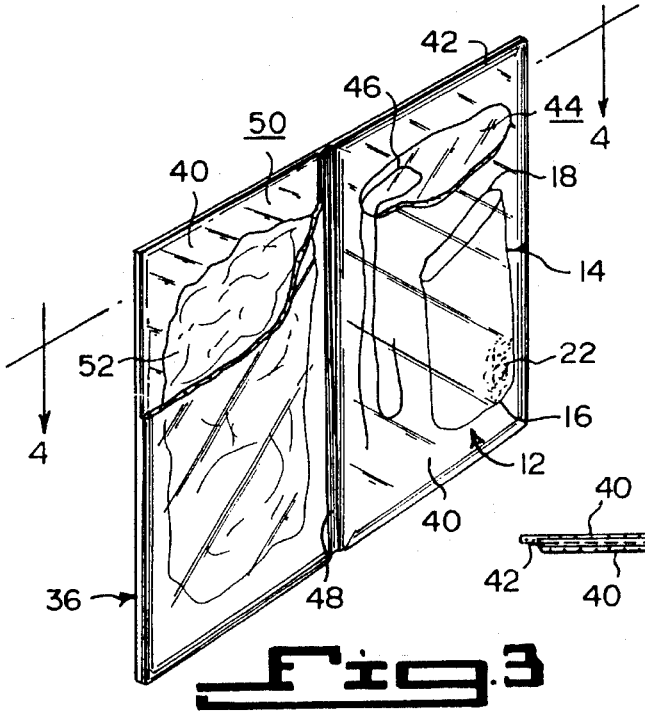
FIG. 3 is an enlarged perspective view with parts broken away of the compact portable package, with the wipe-applicator therein.
Figure 4:
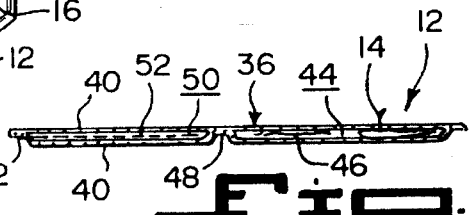
FIG. 4 is a cross sectional view taken along line 4—4 in FIG. 3.
Figure 5A:
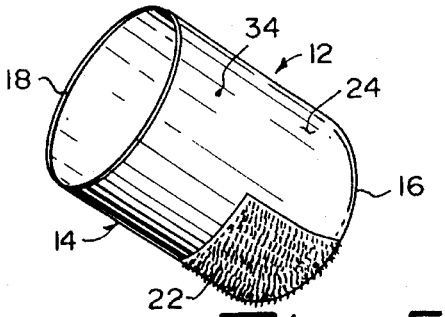
FIG. 5A is a perspective view of the wipe-applicator in an opened condition.

Turning now descriptively to the drawings, in which similar reference characters denote similar elements throughout the several views, FIGS. 1 through 9 illustrate a combination absorbent applicator, wipe for teeth and oral applicator 12, comprising a sheath 14 having a closed distal end 16 and an open proximal end 18 for receipt of a fingertip or finger 20. An abrasive absorbent material pad 22 is on an exterior surface 24 of the sheath 14 adjacent the closed distal end 16. The abrasive absorbent material pad 22 can be applied to teeth 26, gums 28, tongue 30 and lips 32, for cleaning and treatment thereof.

The sheath 14 is fabricated out of soft latex biodegradable material 34. The abrasive absorbent material pad 22 can be secured to the exterior surface 24 of the sheath 14, adjacent the closed distal end 16. The abrasive absorbent material pad 22 can also be integral with the exterior surface 24 of the sheath 14, adjacent the closed distal end 16.

FIGS. 1 through 4 show a compact portable package 36, to enclose the sheath 14 with the abrasive absorbent material pad 22 therein in a sanitary manner. The package 36 can be conveniently placed into a wallet 38, as in FIG. 1, and any other article, transported from place to place and then opened, to allow the sheath 14 with the abrasive absorbent material pad 22 to be removed from the package 36 and used.

The compact portable package 36 includes a pair of transparent plastic sheets 40, placed one upon another. A heat seal seam 42 is about the perimeter of the sheets 40, so as to form a compartment 44 to retain the sheath 14 with the abrasive absorbent material pad 22 therein.

The compact portable package 36 further contains a piece of dental floss 46 placed within the compartment retaining the sheath 14 with the abrasive absorbent material pad 22. When the piece of dental floss 46 is removed from the compartment 44, it can be used to clean between the teeth 26.

The sheets 40 have an additional heat seal seam 48 between opposite side edges thereof, so as to form two compartments 44 and 50. The first compartment 44 will retain the sheath 14 with the abrasive absorbent material pad 22 and the piece of dental floss 46 therein. A single supply of toothpaste or medicated gel 52 is placed within the second compartment 50. When the single supply of toothpaste or medicated gel 52 is removed from the second compartment 50, it can be placed upon the abrasive absorbent material pad 22 and used.

Figure 8:
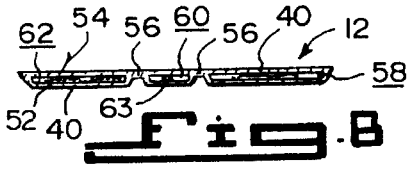
FIG. 8 is a cross sectional view taken along line 8—8 in FIG. 7.
Figure 7:
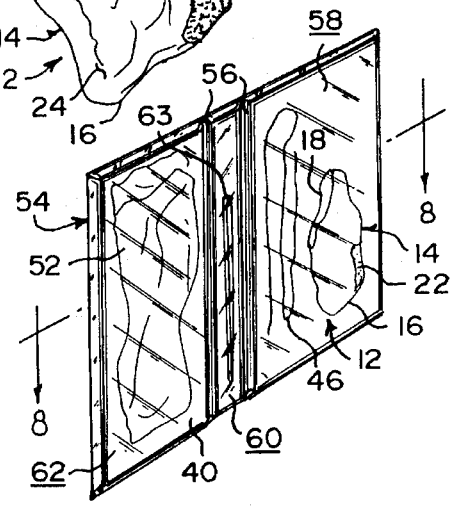
FIG. 7 is a perspective view of a second type of compact portable package with the wipe-applicator therein.

A second compact portable package 54, shown in FIGS. 7 and 8, consists of the sheets 40 having two spaced apart additional heat seal seams 56 between opposite sides thereof, so as to form three compartments 58, 60 and 62. The first compartment 58 will retain the sheath 14 with the abrasive absorbent material pad 22 therein. A piece of dental floss 46 is placed within the first compartment 60. When the piece of dental floss 46 is removed from the first compartment 60, it can be used to clean between the teeth 26. A toothpick 63 is placed within the second compartment 60. When the toothpick 63 is removed from the second compartment 60, it can be used to pick food particles from between the teeth 26. A single supply of toothpaste or medicated gel 52 is placed within the third compartment 62. When the single supply of toothpaste or medicated gel 52 is removed from the third compartment 62, it can be placed upon the abrasive absorbent material pad 52 and used.

Figure 9:
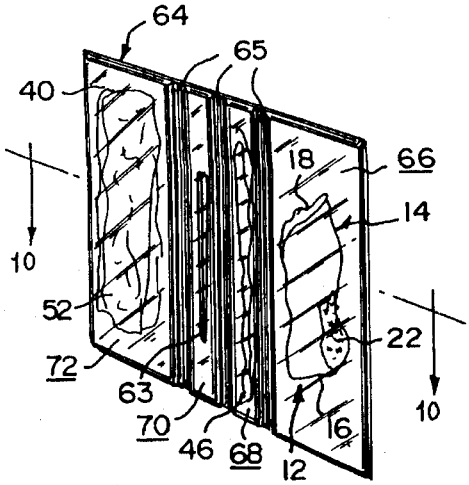
FIG. 9 is a perspective view of a third type of compact portable package with the wipe-applicator therein.
Figure 10:
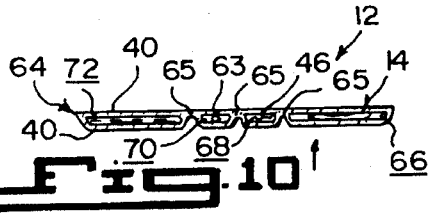
FIG. 10 is a cross sectional view taken along line 10—10 in FIG. 9.

A third compact portable package 64, shown in FIGS. 9 and 10, consists of the sheets 40 having three spaced apart additional heat seal seams 65 between opposite sides thereof, so as to form four compartments 66, 68, 70 and 72. The first compartment 66 will retain the sheath 14 with the abrasive absorbent material pad 22 therein. A piece of dental floss 46 is placed within the second compartment 68. When the piece of dental floss 46 is removed from the second compartment 68, it can be used to clean between the teeth 26. A toothpick 63 is placed within the third compartment 70. When the toothpick 70 is removed from the third compartment 70, it can be used to pick food particles from between the teeth 26. A single supply of toothpaste or medicated gel 52 is placed with the fourth compartment 72. When the single supply of toothpaste or medicated gel is removed from the fourth compartment 72, it can be placed upon the abrasive absorbent material pad 22 and used.

Figure 6:
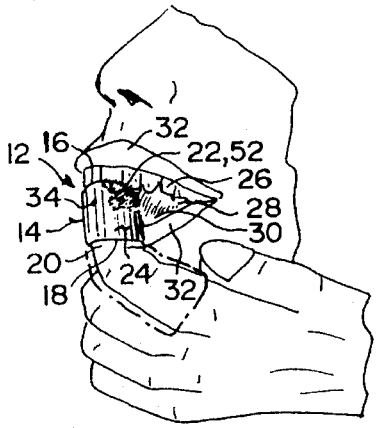
FIG. 6 is a perspective view of the wipe-applicator on an index finger being applied to the teeth.
Figure 5:
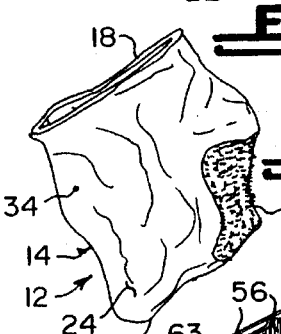
FIG. 5 is a perspective view of the wipe-applicator in a collapsed condition.
Figure 6A:
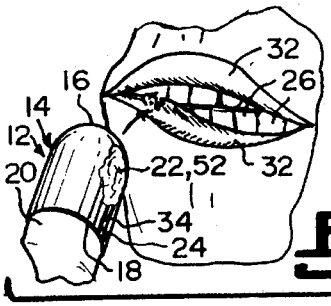
FIG. 6A is a perspective view of the wipe-applicator on the index finger being applied to a sore lip.

The major use of applicator 12 is a wipe for sensitive teeth 26 instead of using a toothbrush. The applicator 12 can also be used for cleaning the teeth 26, as shown in FIG. 6 and to apply medication for denture sores and canker sores on the lips 32, gums 28 and tongue 30, as shown in FIG 6A. The applicator 12 is used one time and then disposed of, so as to maintain sanitary conditions in and about the mouth.

LIST OF REFERENCE NUMBERS

12 combination absorbent applicator, wipe for teeth
14 sheath

16 closed distal end of 12
18 open proximal end of 12
20 fingertip or finger
22 abrasive absorbent material pad at 14
24 exterior surface of 14
26 teeth
28 gums
30 tongue
32 lips
34 soft latex biodegradable material for 14
36 first compact portable package
38 wallet
40 transparent plastic sheet
42 heat seal seam in 36
44 first compartment in 36
46 piece of dental floss
48 additional heat seal seam in 36
50 second compartment in 36
52 single supply of toothpaste or medicated gel
54 second compact portable package
56 additional heat seal seam in 54
58 first compartment in 54
60 second compartment in 54
62 third compartment in 54
63 toothpick
64 third compact portable package
65 additional heat seal seam in 64
66 first compartment in 64
68 second compartment in 64
70 third compartment in 64
72 fourth compartment in 64

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A compact portable package sized and shaped for insertion into a wallet for use in oral hygiene comprising:

a) a pair of transparent sheets placed one upon another having heat seal seams around the perimeter of said sheets and on the surfaces of said sheets to form a plurality of compartments open along one edge of said sheets;

b) within one compartment of said package a combination absorbent applicator, wipe for teeth and oral applicator means comprising a sheath of soft latex biodegradable material having a closed distal end and an open proximal end whose length is suitable for receipt of a fingertip and an abrasive absorbent material pad on and integral with an exterior surface of said sheath adjacent said closed distal end permitting said abrasive absorbent material pad to be applied to teeth, gums, tongue and lips for cleaning and treatment thereof, said sheath being unrolled and collapsed into a flat configuration stored within said compartment of said package;

b) a supply of dental floss located within the same compartment as said applicator;

c) a toothpick located within a second compartment formed between said sheets of plastic by another heat seam;

d) a single supply of toothpaste/medicated gel located within a third compartment formed between said sheets of plastic by still another heat seam.

* * * * *